United States Patent [19]

Salvesen

[11] 4,408,204

[45] Oct. 4, 1983

[54] DIGITAL COUNTER/TRANSMITTER WITH REMOTE RECEIVER/DISPLAY

[75] Inventor: Richard S. Salvesen, Hampton, Iowa

[73] Assignee: Midwest Computer Register Corp., Hampton, Iowa

[21] Appl. No.: 175,857

[22] Filed: Aug. 6, 1980

[51] Int. Cl.[3] ..... G08C 19/16

[52] U.S. Cl. ..... 340/870.24; 340/870.02; 340/870.19

[58] Field of Search ..... 340/870.02, 870.03, 340/870.24, 870.19, 870.2, 870.22; 377/37, 44

[56] References Cited

U.S. PATENT DOCUMENTS

| | | | |
|---|---|---|---|
| 3,125,750 | 3/1964 | Bussey | 340/870.24 |
| 3,641,536 | 2/1972 | Prosprich | 340/870.24 |
| 3,786,423 | 1/1974 | Martell | 340/870.03 |
| 3,820,073 | 6/1974 | Vercellotti et al. | 340/870.03 |
| 4,027,301 | 5/1977 | Mayer | 340/870.24 |
| 4,119,948 | 10/1978 | Ward et al. | 340/870.02 |

*Primary Examiner*—James J. Groody

*Attorney, Agent, or Firm*—Schwartz, Jeffery, Schwaab, Mack, Blumenthal & Koch

[57] ABSTRACT

A digital counter receives pulses from a transducer monitoring gasoline pumped, articles moving along an assembly line, count processes in batch controlled systems, or the like. The counter stores four decades of BCD encoded data. The counter is continuously scanned and the data converted digit by digit into a serial stream of pulse width modulated bursts containing the BCD data for each digit accompanied by its associated address in the counter. The receiver operates in the reverse of the transmitter. Each incoming pulse rising edge triggers two pulse generators. If the first pulse generator times out prior to the received pulse, the received pulse will be clocked into a shift register. The second pulse generator is continuously reset during receipt of a sequence of digits. When the second pulse generator times out, the contents of the shift register is latched into a display controller. The receiver distinguishes between individual pulses and consecutive decades by the time delay between received pulses. An "off" pulse generator is provided for inhibiting data bit transmission for a first predetermined time between individual pulses of a decade and an "interdecade" pause generator is provided for inhibiting transmission of data bits of consecutive decades to produce a time delay between decades.

16 Claims, 5 Drawing Figures

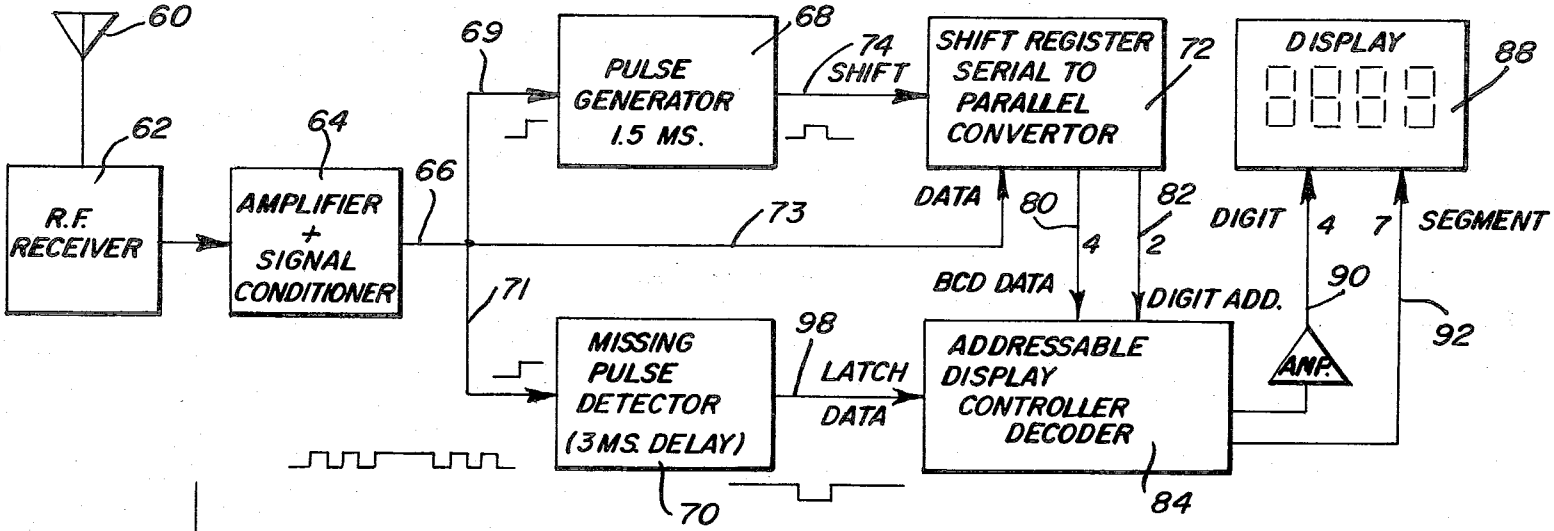
FIG. 2
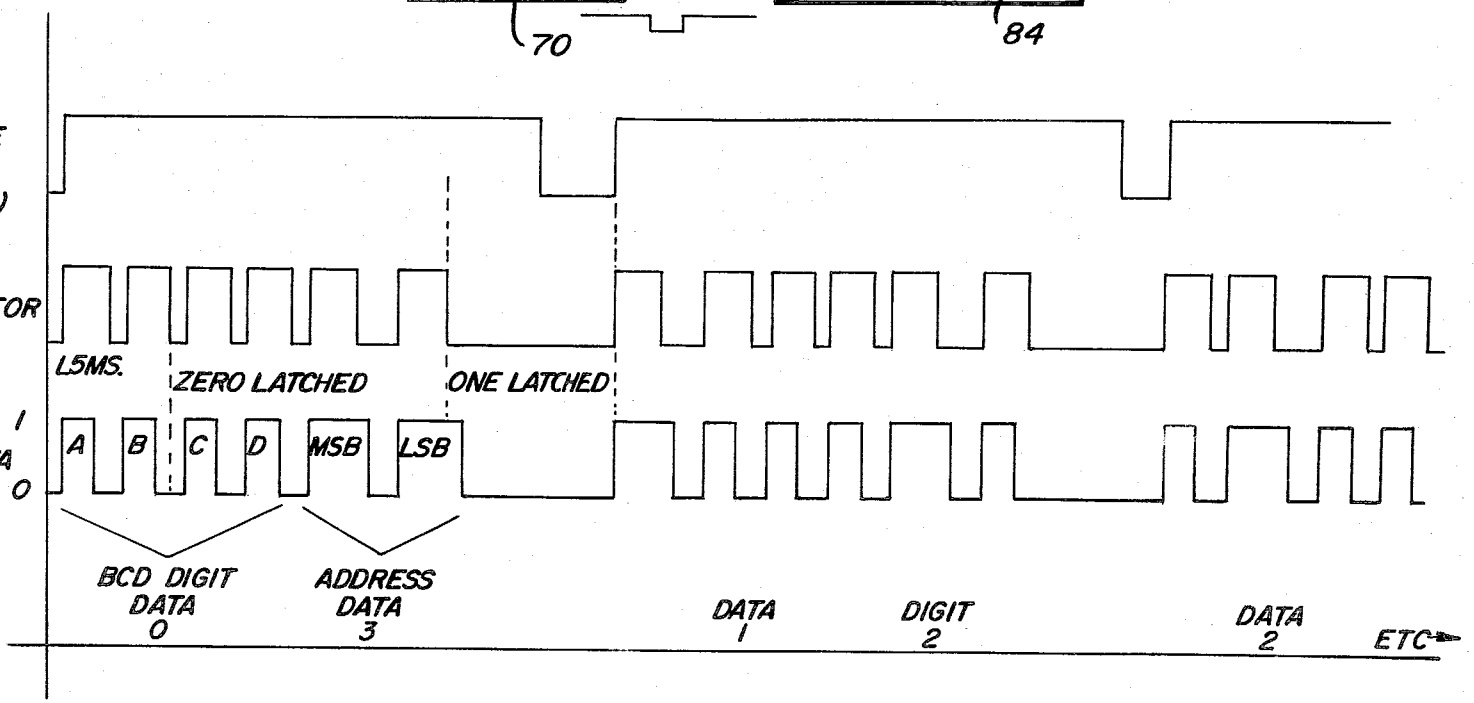
FIG. 3a
FIG 3b
FIG. 3c

DIGITAL COUNTER/TRANSMITTER WITH REMOTE RECEIVER/DISPLAY

BACKGROUND OF THE INVENION

1. Field of the Invention

This invention relates to the display of counted totals to be monitored at a remote location with the information to be transferred by radio telemetry to a display station.

2. Discussion of Related Art

It is often desirable to monitor an event at one location, transmit the monitored information to a second location without the use of wires or mechanical connections and display the transmitted information. One application of such a system can readily be understood with respect to self-service filling stations wherein a single attendant must keep track of amount of fuel being pumped by each customer. Since the attendant is unable to see the individual pump registers, it is necessary to transmit the information from each customer-operated pump to a central control and display panel. Obviously, this information must be transmitted accurately and a continuous update of the counted total of fuel pumped is necessary to insure that the final charge to the customer is accurate.

Other examples wherein monitoring and remote display of a counted total is desirable include counting the number of products moving down an assembly line and monitoring outputs of hospital equipment. In this latter example, it would be desirable to allow a portable display to be carried by, for instance, hospital personnel who are required to monitor the hospital equipment but are not fixed at a given permanent location.

Certain remote monitoring systems have been suggested. For instance, U.S. Pat. No. 3,609,729, issued Sept. 28, 1971 to Anderson, shows a telemetry system wherein a numerical count proportional to a parameter is momentarily stored in a series arrangement of multistage counters. The information in the counters is transmitted using pulse position modulation, a receiver decodes the information and records it on a strip chart recorder. U.S. Pat. No. 3,659,277, issued Apr. 25, 1972 to Brown, shows a receiver transmitter apparatus including a hard wired connection between the receiver and transmitter. The transmitter provides an output pulse train, the repetition rate of which is proportional to the amplitude of the signal of the transmitter input. Also, power for the transmitter is derived from the receiver through the hard wired connection. U.S. Pat. No. 3,786,423, issued Jan. 15, 1974 to Martell, discloses a method and apparatus for remotely reading one or more meters from a central location. The meter information is supplied to an accumulator, the information from which is placed into a shift register and sequentially shifted out into a frequency shift keying oscillator where frequency is encoded and transmitted via telephone lines to a central station. U.S. Pat. No. 4,119,948, issued Oct. 10, 1978 to Ward et al, shows a remote meter reading system which includes an electro-optical transponder effective to receive and transfer data from a monitor unit and to convert the data into a train of laser radiation pulses which are emitted in response to interrogation by a laser radiation pulse from a remote mobile interrogator unit. U.S. Pat. No. 4,194,177, issued Mar. 18, 1980 to Adamson, shows a system for continuous monitoring of liquid levels in storage tanks. The system includes a differential pressure cell in circuit with a digital volt meter which in turn is connected to a series of look-up, read only memories (ROM). The digital volt meter continuously applies BCD signals to the ROMs. The ROMs retain in memory the gray code translation of the BCD input and are periodically accessed via an analog multiplexer.

SUMMARY OF THE INVENTION

One object of the present invention is to provide a transmitter receiver pair capable of receiving digital input from a variety of sources including switch closures, TTL signals, CMOS signals. Up to four digits of data are stored in binary coded decimal form and transmitted to a selfcontained receiver having a digital display. The use of binary coded decimal storage reduces the complexity necessary for the display thus enabling the receiver and display to be configured in a small, compact unit which can be easily portable.

A further object of the present invention is to provide a transmitter receiver pair wherein the transmitter is configured in a manner in which counting is independent of formatting and transmitting. Therefore, the transmitted information is accurate up to within one display update which is typically 80 milliseconds of the count input.

An additional object of the present invention is to provide a transmitter receiver pair wherein transmission is redundant in that all four digits of the information are transmitted typically every 80 milleseconds. Therefore any interference causing an error in the received signal will automatically be negated by the next transmission which will replace the entire incorrect display with a corrected display.

A further object of the present invention is to provide a transmitter receiver pair wherein transmission is via a radio frequency link thus allowing reception anywhere within a predetermined radius of the transmitter.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is a block diagram of the receiver/display of the present invention.

FIGS. 3*a*, 3*b* and 3*c* are timing charts showing sets of square waves as they appear at various points in the receiver/display of FIG. 2.

DESCRIPTION OF THE PREFERRED EMBODIMENT

Figure 1:
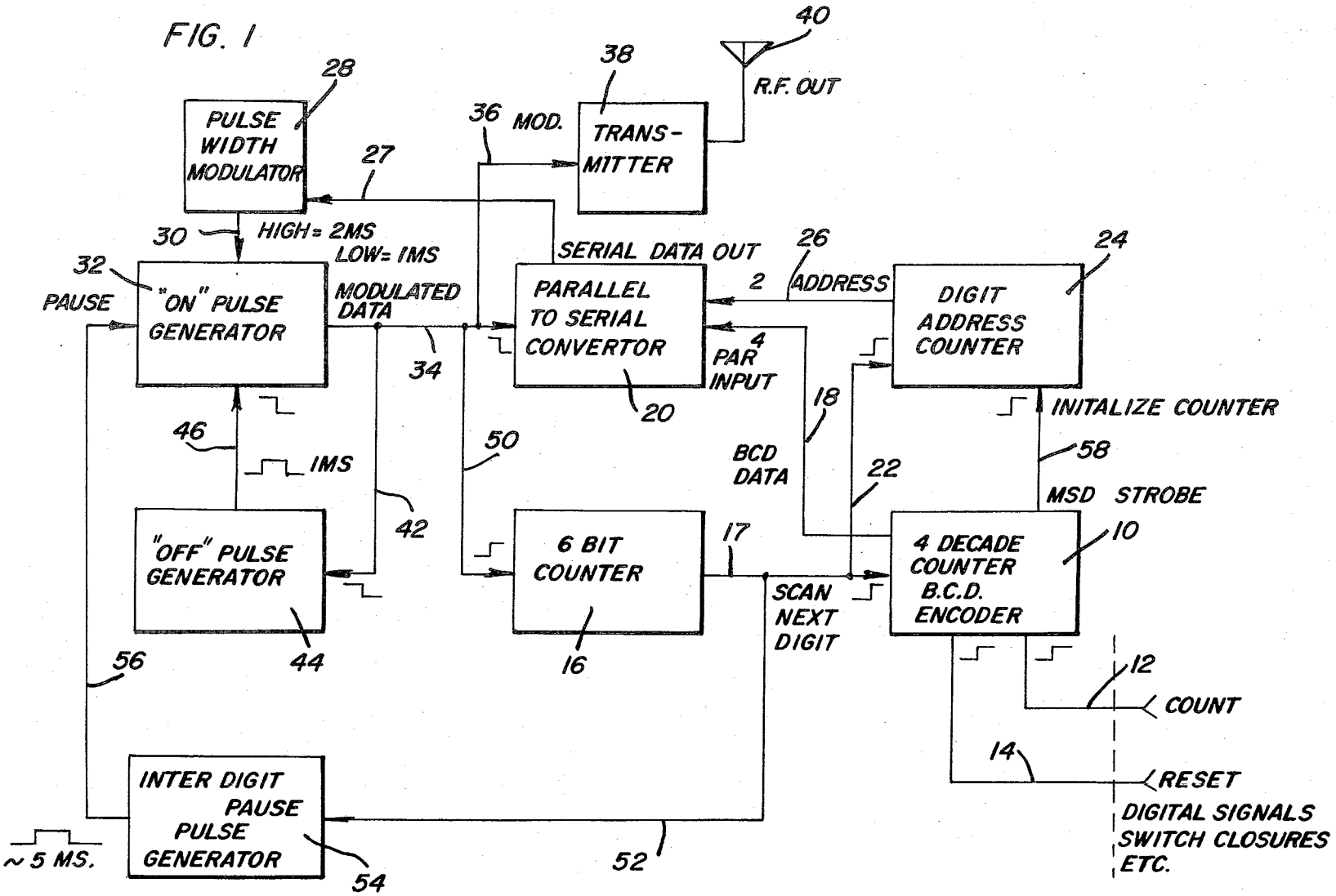
FIG. 1 is a block diagram of the counter/transmitter of the present invention.

Now with reference to the drawings, a digital counter/transmitter with remote receiver/display incorporating the principles and concepts of the present invention will be described in detail. With particular reference to FIG. 1, it will be seen that the counter/transmitter shown therein includes a four decade counter 10 which receives input pulses on line 12. These input pulses can be generated by any suitable means such as switch closures, optical pulse generators, magnetic pulse generators, any type of logic circuitry, etc. The pulses received on line 12 are stored in counter 10 in a binary coded decimal (BCD) format in order to accommodate the receiver/display circuitry to be discussed hereinafter. A reset input 14 is also applied to the counter 10 for initializing the count in each of the decades. The count and reset inputs are formed externally of the counter and totally control the data contained within the counter. Thus, the counter is asynchronous in nature in that it is independent of the rest of the circuitry of the invention and is only effected by the inputted signal. By way of example, the inputted signals on count line 12 could be generated by a pump at a self-service filling station with one pulse being generated per volume of fuel delivered into a user's tank. When the pump is initially energized, a reset signal will be supplied on line 14 to initialize the counter 10 to a zero state. As gasoline is pumped by the user, the data stored in counter 10 is indicative of the total volume of fuel that has been dispensed.

The remainder of the circuitry of FIG. 1 has for its purpose the continuous scanning of the data contained in counter 10 and the transmission of that data to a receive and display station. The data in counter 10 is scanned one decimal digit at a time by six bit counter 16. A high output on line 17 from counter 16 makes available the next sequential digit from counter 10 in parallel form on lines 18. This parallel digit information containing four bits of information is inputted to parallel to serial converter 20. At the same time, a high input on line 22 causes an additional count to be added to digit address counter 24 which keeps track of the position of the digit being outputted from counter 10. Counter 24 contains two bits which are made available in parallel form on line 26 to indicate the address of the BCD data being outputted from counter 10 to lines 18. For purposes of explanation, an output on parallel lines 26 equal to zero in binary form indicates the presence of the least significant digit (LSD) on parallel lines 18 while a 3 in binary form on lines 26 indicates the presence of the most significant digit (MSD). Accordingly, it it can be seen that six bits are presented in parallel form to the converter 20. These bits are outputted in serial form on line 27 and received by pulse width modulator 28. A "high" input on line 27 to pulse width modulator 28 causes an output on line 30 commanding a two millisecond pulse to be emitted by pulse generator 32 on line 34. A "low" input on line 27 causes pulse generator 32 to emit a one millisecond pulse on line 34. Each such pulse generated by pulse generator 34 is delivered on line 36 to transmitter 38 which produces radio frequency pulses which are transmitted through an antenna 40. Each pulse outputted from pulse generator 32 is also delivered through line 42 to "off" pulse generator 44 which in effect inhibits operation of the pulse generator 32 for one millesecond. Pulse generator 44 is triggered by the trailing edge of the pulse on line 42 and thus the one millisecond inhibit pulse on line 46 creates a one millesecond delay between transmitted bits. The trailing edge of the pulse on line 34 also sequences converter 20 so that the next serial bit of information is delivered on line 27 to pulse with modulator 28. Furthermore, the pulsed information is delivered via line 50 to counter 16. Accordingly, the count in counter 16 is indicative of the number of bits of information transmitted via antenna 40. Obviously, since each digit contains six bits of information, it is desirable to sequence counter 10 after six bits of information have been transmitted so that the next digit is delivered to the parallel converter 20. This is the function of counter 16. When the six bits have been counted thereby, a "high" signal is outputted on line 17. This signal sequences both counter 10 and counter 24 and thereby causes the next sequential digit to be delivered to converter 20. At the same time, that high pulse is delivered through line 52 to interdigit pause pulse generator 54 which emits a five millisecond pulse on line 56 which inhibits pulse generator 30 for five milliseconds thereby indicating to the receiver/display the completion of transmission of a single digit and allowing time for that digit to be latched into the display as will be discussed in detail hereinafter.

Naturally, upon completion of four cycles as discussed above, all four decades of the counter 10 will have been read and transmitted. The cyclic operation continues to occur. To insure correspondence between the digit address stored in counter 24 and the digit being outputted from counter 10, each time that a given digit, for instance, the most significant digit of counter 10 is outputted, the counter 24 is strobed through line 58 to initialize that counter to a given preset corresponding digit address count.

Although operation of the counter/transmitter would be apparent from the foregoing, for additional clarification, the operation thereof will now be described with reference to FIG. 3*c* which shows pulse width modulated pulses as they would appear on line 34. Clearly, it is to be assumed that the MSD of counter 10 is a decimal zero. This information is transmitted through line 18 in the form of four "low" parallel bits accompanied by two "high" bits on line 26 from digit address counter indicating the presence of the MSD. These six bits are serially outputted from converter 20 on line 27 starting with the most significant bit (MSB) of the BCD digit data and ending with the least significant bit (LSB) of the address data. The four bits of information comprising the BCD data are labelled A through D in FIG. 3*c*. Bit A is a one millisecond pulse outputted from generator 32 in response to a "low" signal seen by modulator 28 on line 27. The leading edge of this pulse increments counter 16 while the trailing edge causes converter 20 to be incremented outputting a "low" signal indicative of bit B. Also, the trailing edge causes a one millisecond inhibit pulse to be seen by generator 32 thus insuring a one millesecond delay between bits A and B. The sequence of operation for bits B-D is then a repeat of operation for bit A. The MSB of the address data is then serially transmitted to modulator 28 in like manner. This bit being "high" causes a two millisecond pulse to be outputted on line 34. This pulse is again followed by a one millisecond "low" signal prior to receipt of the LSB of the address data. The LSB of the address data, being the last bit transmitted, causes six bit counter 16 to output a "high" pulse on line 17. This high pulse then causes interdigit pause pulse generating 54 to inhibit operation of pulse generator 32 for 5 milliseconds and also to increment the address counter 24 and four decade counter 10. The next six bits comprising four data bits from counter 10 and two data bits from counter 24 are then presented to converter 20 and the cycle of operation continues.

Now with reference to FIG. 2, the operation of the receiver/display of the invention will be described. The radio frequency pulses transmitted by antenna 40 of the counter/transmitter are received by antenna 60 shown in FIG. 2. These pulses are detected by receiver 62 and amplified and conditioned by circuit 64 and delivered to line 66 as duplicates of the data pulses seen in FIG. 3*c*. These data pulses are delivered to 1.5 millesecond pulse generator 68 on line 69, 3 millisecond pulse generator 70 on line 71, and the data input of shift register 72 on line 73. The 1.5 millesecond pulse from pulse generator 68 is triggered by the leading edge of the data pulse on line 69 and is presented to the shift input of shift register 72 on line 74.

The pulse generator 68 discriminates between "high" and "low" input data signals. As discussed above, a "low" data bit is indicated by a one millisecond duration pulse. Obviously, this one millisecond data pulse on line 73 will time out prior to the 1.5 millisecond pulse on line 74. Accordingly, since shift register 72 is actuated by the trailing edge of the pulse on line 74, when this trailing edge is seen by the shift register, the signal at the data input on line 73 will be a zero. Thus, a "low" signal will be entered into the shift register. Conversely, when a two millisecond pulse is presented on line 66, that pulse will time out after the 1.5 millisecond pulse on line 74 and a "high" signal will be presented on the data input when the shift register is actuated by the trailing edge of the 1.5 millisecond pulse. In this manner, all six bits of data present on the received signal will be inputted to the shift register. These bits are available in parallel form on output lines 80 and 82 which are inputs to display controller 84.

Controller 84 is operative in a known manner to control illumination of the four numerical digits of display panel 88. The digits are individually enabled by an appropriate signal on one of four lines shown at 90. The segments of that digit are then illuminated by appropriate signals on seven lines shown at 92 in a manner well known in the art.

The pulse generator 70 is operative to latch the information on lines 80 and 82 into controller 84 after all bits of a particular digit have been received. Receipt of the bits is determined by sensing the five millisecond pause between digits. Since the normal pause between bits is one millisecond, pulse generator 70 is continually retriggered and thus the output on line 98 is constantly high. When a five millisecond pause between digits is sensed, the pulse generator 70 times out thus producing a "low" signal on line 98. The trailing edge of this signal latches the new information into the controller thus causing illumination of the appropriate segments of display 88.

With reference to FIGS. 3*a–c*, the operation of the circuit of FIG. 2 will be even more readily apparent. FIG. 3*c* shows the data pulses as they would appear on line 66. FIG. 3*b* shows the output of pulse generator 68 which comprises a plurality of 1.5 millisecond pulses whose leading edges are coincident with the leading edges of the data bits of FIGS. 3*c*. Clearly, the trailing edge of each 1.5 milliseconds pulse follows the trailing edge of each data pulse A through D. Consequently, the data inputted to shift register 72 for each bit A through D would be a "low" signal. Conversely, the trailing edge of each address data bit follows the trailing edge of the corresponding 1.5 second pulse. Clearly, this results in a "high" input signal being inputted to the shift register for each of the address bits. Following six bits of information, the first five millisecond pause is encountered. With reference to FIG. 3*a*, it will be seen that the output of pulse generator 70 on line 98 is high from the time of the leading edge of data pulse A until the five millisecond pulse is encountered. At this time, pulse generator 70 is able to time out. The trailing edge of that pulse then latches the parallel data in the shift register 72 into the display controller 84 for updating the appropriate digit of the display 88.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An asynchronous system for remotely monitoring a counted total and locally displaying that total, said system comprising:

counter means for receiving input pulses and maintaining a stored count of said received pulses as data in counter elements;

scanning means for sequentially accessing data in each element of said counter means;

address counter means for assigning an address to data from each said element indicative of the position of the element containing the addressed data relative to the other elements in said counter means;

pulse width modulator means for receiving data from each element of said counter means when accessed by said scanning means and the assigned address and pulse width modulating said data and assigned address;

transmitter means for receiving said pulse width modulated data and assigned address and transmitting pulses in response thereto;

receiving means for receiving said pulses;

discriminator means for converting said pulses into discrete amplitude signals indicative of said data and assigned addresses; and display and control means for displaying said discrete amplitude signals indicative of said data in accordance with the assigned address.

2. The invention as defined in claim 1 wherein said counter means comprises a multi-decade counter with each of said elements comprising one decade of said counter and in which the output signal of each decade comprises bits of information outputted in parallel form in response to a given element being accessed by said scanning means.

3. The invention as defined in claim 2 and further including a parallel to serial converter for receiving said parallel bits and outputting said bits in serial form, and wherein said transmitter means is operative to transmit individual data bits.

4. The invention as defined in claim 3 wherein said scanning means includes a bit counter means for counting bits of data transmitted by said transmitter means and sequencing said counter means when all bits of a single decade have been transmitted.

5. The invention as defined in claim 4 and further including an off pulse generator means responsive to transmitted data bits for inhibiting data bit transmission for a first predetermined time between data bits.

6. The invention as defined in claim 5 and further including an interdecade pause generator for inhibiting transmission of data bits for a second predetermined time after all bits of a single decade have been transmitted.

7. The invention as defined in claim 4 and wherein said address counter means outputs a signal indicative of the significance of an associated decade output of said counter means, said address counter being operatively connected to said bit counter means for sequencing thereby.

8. The invention as defined in claim 7 wherein said address counter means includes a parallel output operatively connected to said pulse width modulator means.

9. An asynchronous system for remotely monitoring a counted total and locally displaying that total, said system comprising:

counter means for receiving input pulses and maintaining a stored count of said received pulses as data in counter elements;

scanning means for sequentially accessing data in each element of said counter means;

address counter means for assigning an address to data from each said element indicative of the position of the element containing the addressed data relative to the other elements in said counter means;

modulator means for receiving data from each element of said counter means when accessed by said scanning means and the assigned address and modulating said data and assigned address;

transmitter means for receiving said modulated data and assigned address and transmitting pulses in response thereto;

receiving means for receiving said pulses;

discriminator means for converting said pulses into discrete amplitude signals indicative of said data and assigned addresses; and display and control means for displaying said discrete amplitude signals indicative of said data in accordance with the assigned address wherein said discriminator means includes a reference pulse generator means operative to emit a reference pulse upon receipt of one of said received pulses; and comparator means for comparing the duration of said reference pulse to said the duration of received pulse.

10. The invention as defined in claim 9 wherein said comparator means comprises a shift register having a shift input for receiving said reference pulse and a data input for receiving said received pulse.

11. The invention as defined in claim 10 and further including a missing pulse detector means for measuring the time lapse between received pulses.

12. The invention as defined in claim 11 wherein said display and control means is operatively connected to said missing pulse detector means and to said shift register for displaying an updated signal in response to the spacing between received pulses being greater than a predetermined time.

13. The invention as defined in claim 12 wherein said missing pulse detector means comprises a retriggerable pulse generator.

14. An asynchronous system for remotely monitoring a counted total and locally displaying that total, said system comprising:

counter means for receiving input pulses and maintaining a stored count of said received pulses in binary coded decimal format containing a plurality of digits;

scanning means for individually accessing each digit of said counter means;

address means for assigning an address to each digit accessed by said scanning means;

modulation means for modulating each digit and assigned address;

transmitter means for transmitting each modulated digit and assigned address;

receiver means for receiving each modulated digit and assigned address;

demodulation means for demodulating each received digit and assigned address; and display means for displaying each digit in accordance with the assigned address such that each digit is displayed relative to other digits in a position determined by the assigned address.

15. The system of claim 14, wherein each digit comprises a group of bits, and said transmitter means comprises means for transmitting each bit with a first predetermined space between bits of a single digit and with a second spacing between groups of bits of different digits.

16. The system of claim 15 wherein said modulation means pulse width modulates each bit of each digit with pulses having a first width to indicate bits having a first value and pulses having a second width to indicate bits having a second value, and said demodulation means includes a shift register having a data input connected to receive said pulse width modulated bits, a pulse generator connected to receive said modulated bits and outputting a pulse having a width intermediate said first and second widths in response to each bit, said shift register having a shift input connected to receive the pulses outputted from said generator, whereby said intermediate width pulses cause said shift register to enter a first value from said data input in response to said first width pulse timing out prior to said intermediate width pulse, or a second value in response to said intermediate width pulse timing out prior to said second width pulse.

* * * * *